United States Patent [19]

Bekaert et al.

[11] 4,225,804

[45] Sep. 30, 1980

[54] CATHODE RAY TUBE COMA CORRECTION DEVICE

[75] Inventors: Johan Bekaert; Raymond Goos, both of Tienen, Belgium

[73] Assignee: GTE Sylvania N.V., Tienen, Belgium

[21] Appl. No.: 11,284

[22] Filed: Feb. 12, 1979

[30] Foreign Application Priority Data

Apr. 22, 1978 [DE] Fed. Rep. of Germany ..... 2817738
Apr. 22, 1978 [DE] Fed. Rep. of Germany ... 7812297[U]

[51] Int. Cl.[3] ..... H01J 29/51; H01J 29/76

[52] U.S. Cl. ..... 313/412; 313/413; 313/431

[58] Field of Search ..... 313/412, 413, 414, 440, 313/431

[56] References Cited

U.S. PATENT DOCUMENTS

| | | | |
|---|---|---|---|
| 3,614,502 | 10/1971 | Doggett et al. | 313/412 |
| 3,840,765 | 10/1974 | Takenaka et al. | 313/431 X |
| 3,860,850 | 1/1975 | Takenaka et al. | 313/431 X |
| 4,057,747 | 11/1977 | Hamano | 313/414 X |
| 4,142,131 | 2/1979 | Ando et al. | 313/412 X |

*Primary Examiner*—Palmer C. Demeo
*Attorney, Agent, or Firm*—Thomas H. Buffton

[57] ABSTRACT

In a self-converging inline cathode ray tube assembly having a convergence electrode with a flat base and a central and two outer apertures formed for passage of electron beams, a pair of substantially flat sheets of ferromagnetic material having a substantially U-shaped configuration are disposed in mirror-image relationship intermediate the central aperture and each one of the outer apertures with the open portion of the U-shaped configuration directed toward the outer apertures whereby the deflection field of the electron beam passing through the central aperture is relatively strengthened and the deflection fields of the electron beams passing through the outer apertures are relatively weakened to provide an enhanced vertical and horizontal scanning raster for the cathode ray tube.

11 Claims, 6 Drawing Figures

CATHODE RAY TUBE COMA CORRECTION DEVICE

TECHNICAL FIELD

This invention relates to inline cathode ray tube structures and more particularly to an improved convergence electrode for correcting horizontal and vertical misconvergence or coma in a self-converging inline color cathode ray tube assembly.

BACKGROUND OF THE INVENTION

In cathode ray tube deflection systems employing an inline cathode ray tube and a deflection yoke affixed to the cathode ray tube, it is a common practice to provide horizontal and vertical deflection of the electron beams such that the electron beams sweep the whole area whereon the display is presented. However, it is known that the inline cathode ray tube in such systems tends to provide a different raster for each electron beam. Moreover, these rasters do not coincide over the total screen area and misconvergence or convergence errors result.

In an effort to compensate for this undesired non-uniformity of the resultant raster, it has been a common practice to provide convergence controls external to the cathode ray tube. These convergence controls were energized and manipulated in a manner such that the electron beams of the cathode ray tube were altered to provide a uniform raster without convergence errors.

With the appearance of and desire for a completely self-converging system wherein the desired convergence of the electron beam is automatically obtained, the prior known adjustment techniques and apparatus were no longer appropriate. Although convergence was still obtainable with such apparatus, the self-converging concept required a departure from known methods and apparatus.

Generally, in self-converging systems for inline cathode ray tubes, the same deflection force does not have an equal effect upon the central electron beam as it has on the outer electron beams. Therefore, deflection of the central electron beam is different from the deflection of the outer electron beams which causes misconvergence or the so-called coma fault. Although this coma fault is present, but hardly desirable, in small or medium size cathode ray tubes, it is an increasingly disturbing factor in cathode ray tubes known as 25V or tubes with a diagonal measurement of about 25 inches.

Additionally, present-day practice tends toward self-converging deflection systems wherein the deflection yokes include two pairs of windings on a core with one pair of windings for horizontal deflection and the other pair for vertical deflection. Moreover, these windings are commonly referred to as saddle and toroid coils or windings respectively. Also, the deflection unit is referred to as a hybrid deflection yoke with the saddle coils forming horizontal deflection windings and the toroid coils forming vertical deflection windings.

One known technique for effecting a self-converging system with an inline cathode ray tube and a hybrid type deflection yoke employs a so-called "large neck" cathode ray tube and a magnetic shunt affixed to the envelope at an appropriate place behind the deflection unit. Although, a self-converging capability without coma fault was achieved the additional neck components and space required left much to be desired. In this connection, reference is made to the article published in "FUNK-TECHNNIK" Nr. 23/1976, pages 764–767.

The paragraph entitled "Coma correction in FTX deflection coils" on page 766 describes the latter solution. Moreover, other known methods for correcting the coma fault are presented in "Transactions BTR", November 1974 and entitled: "Deflection in the 20 AX system" by Kaashoek and the "20 AX System and picture tube" by Barten.

The problem in using hybrid deflection coils is also treated in an article in "IEEE Transactions On Consumer Electronics", Vol. CE-23, Nr. 3, of August 1977 by Ando, Hiroto and others entitled "New Self Convergence Yoke and Picture Tube Systems with 110° In-line Feature". Therein, the coma problem is resolved, as shown in FIG. 11, page 379 for picture tubes with 110° deflection by two three-dimensionally bent metal sheet parts. However, the solution is expensive due to the necessity of an elaborate, solid fixture on the last grid electrode. Moreover, experience indicates that delta tube structures having three-dimensional structures requiring a constant distance between upstanding plates are difficult to effect and it is the intention of the present invention to overcome this disadvantage.

SUMMARY OF THE INVENTION

In one aspect of the invention, a self-converging inline cathode ray tube assembly includes an inline cathode ray tube having a convergence electrode with a substantially flat base and a central aperture and a pair of outer apertures aligned in a plane and providing passageway for electron beams. A pair of flat sheets of ferromagnetic material are affixed to the base and disposed in mirror-image relationship intermediate the central aperture and an outer aperture with each of the sheets having a substantially U-shaped configuration with the open end thereof directed toward the outer aperture of the convergence electrode whereby the ferromagnetic sheets weaken the vertical deflection field of the outer apertures and strengthens the vertical deflection field of the central aperture. Also, coma faults in the horizontal scan direction are corrected by the ferromagnetic sheets whereby alteration of the horizontal deflection field for the outer beams with respect to the central beams is provided.

PREFERRED EMBODIMENT OF THE INVENTION

For a better understanding of the present invention, together with other and further objects, advantages and capabilities thereof, reference is made to the following disclosure and appended claims in conjunction with the accompanying drawings.

Generally, cathode ray tube assemblies utilizing inline cathode ray tubes having a relatively large deflection angle present a problem in attempts to achieve a completely self-converging system. More specifically, the fact that one of the electron beams passes through a central aperture while two of the electron beams pass through outer apertures causes an unequal effect upon deflection of the electron beams by a magnetic force applied thereto. Thus, deflection of the electron beams passing through the central aperture is different which causes misconvergence or the so-called "coma fault".

It has been found that this coma fault in the horizontal direction of deflection may be largely compensated for by appropriate winding distribution of the attended deflection yoke. However, some correction in the horizontal direction is appropriate and desirable. Also, the coma fault in the vertical direction has been found to be such that the deflection field associated with the electron beams passing through the outer apertures requires weakening while the electron beam passing through the central aperture requires strengthening if misconvergence or a coma fault is to be eliminated or at least greatly reduced.

Figure 1:
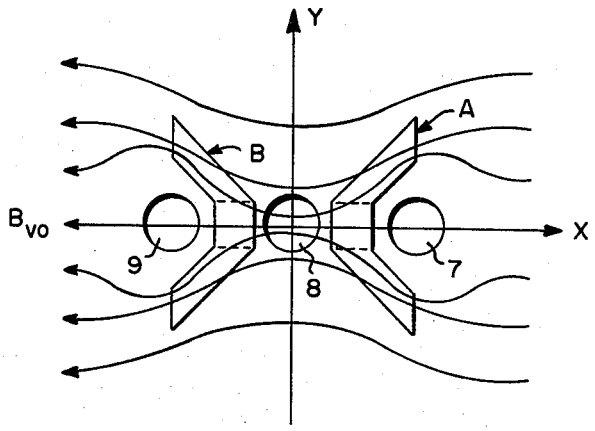
FIG. 1 is a diagrammatic illustration of the lines of force in the vertical deflection field for a preferred embodiment of the invention.

More specifically, FIG. 1 illustrates a convergence electrode structure for an inline cathode ray tube. Therein, a plurality of apertures 7, 8 and 9 are aligned in a single plane or along an x-axis. A pair of substantially U-shaped sheets A and B, which will be more fully explained hereinafter, are disposed intermediate the apertures 7 and 8 and 8 and 9. As can readily be seen, the sheets A and B tend to shunt the magnetic flux lines Bv, directed along the horizontal or x-axis, away from the two outer apertures 7 and 9 while concentrating the flux lines Bv at the central aperture 8. Thus, vertical deflection along the y-axis of an electron beam passing through the center aperture 8 would be strengthened while the vertical deflection of the electron beams passing through the two outer apertures 7 and 9 would be weakened.

Figure 2:
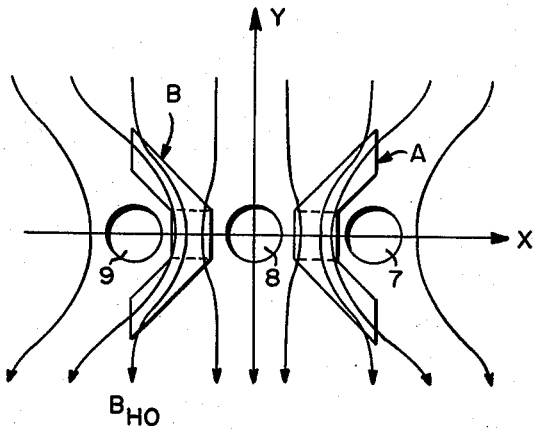
FIG. 2 is a diagrammatic illustration of the lines of force in the horizontal deflection field for the embodiment of FIG. 1.

In FIG. 2, a similar structure illustrates effect thereof on the magnetic flux lines $B_H$ for effecting horizontal scanning of the electron beams. As can be seen, the sheets A and B tend to shunt the magnetic flux lines $B_H$ for all of the apertures, 7, 8 and 9 respectively. By selecting the right dimensions for the plates 13, 15 and 17, it is possible to control the weakening of the three apertures 7, 8 and 9 separately. Thus, the magnetic field for the central aperture 8 can be weakened with respect to the outer apertures 7 and 9 and errors in both direction can be corrected.

Figure 3:
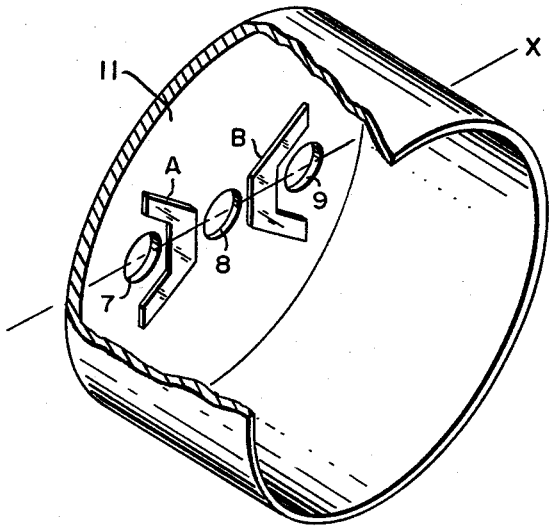
FIG. 3 is a perspective view of a convergence electrode for an inline cathode ray tube illustrating a preferred embodiment of the invention.

Referring to the specifics of the convergence electrode structure, FIG. 3 illustrates a convergence electrode for an inline cathode ray tube. Therein, a central aperture 8 and two outer apertures 7 and 9 respectively are aligned in a plane or along a horizontal or x-axis. The convergence electrode has a substantially flat base portion 11 to which a pair of substantially flat U-shaped sheets of ferromagnetic material A and B are affixed as by welding or other equally appropriate means.

Figure 4:
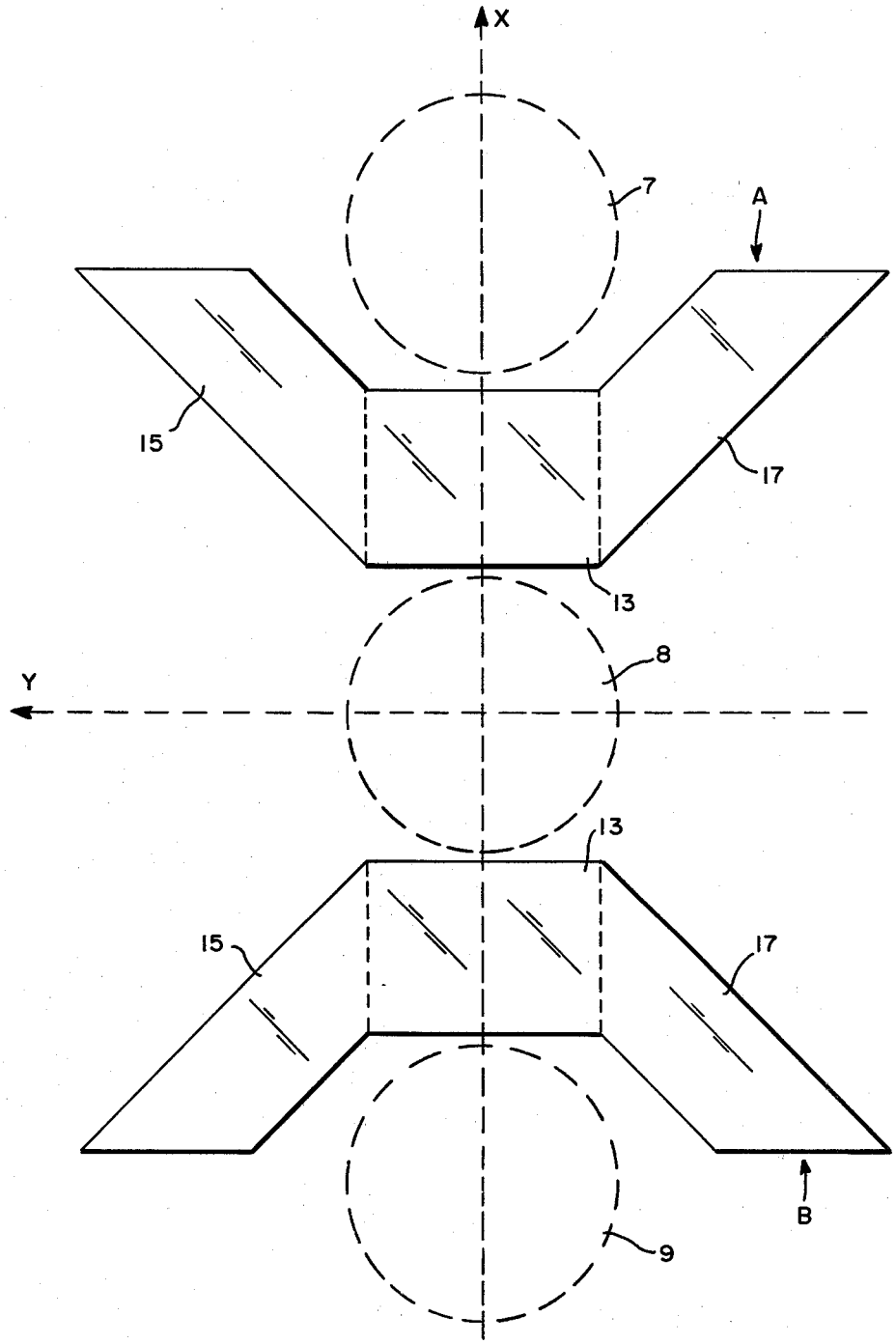
FIG. 4 is an enlarged view of the preferred embodiment of the invention.

As can be more easily seen in the enlarged view of FIG. 4, the substantially U-shaped sheets, A and B, of ferromagnetic material are disposed in mirror-image relationship intermediate the central aperture 8 and each one of the outer apertures 7 and 9. Also, each of the U-shaped sheets, A and B has an open portion directed toward the two outer apertures 7 and 9 and is symmetrical with respect to both the x and y-axes of the convergence electrode.

In this preferred embodiment, each of the ferromagnetic sheets A and B includes a rectangular-shaped mid-portion 13 arrayed intermediate the central aperture 8 and one of the outer apertures 7 and 9. Trapezoidal-shaped wing portions 15 and 17 are affixed to opposite ends of the mid-portion 13 and extend outwardly therefrom to at least partially surround the outer apertures 7 and 9. Moreover, the wing portions 15 and 17 are extended outwardly to a point whereat an imaginary line passing through the center of the outer apertures 7 and 9 would intercept the extremities of the wing portions 15 and 17.

Figure 5:
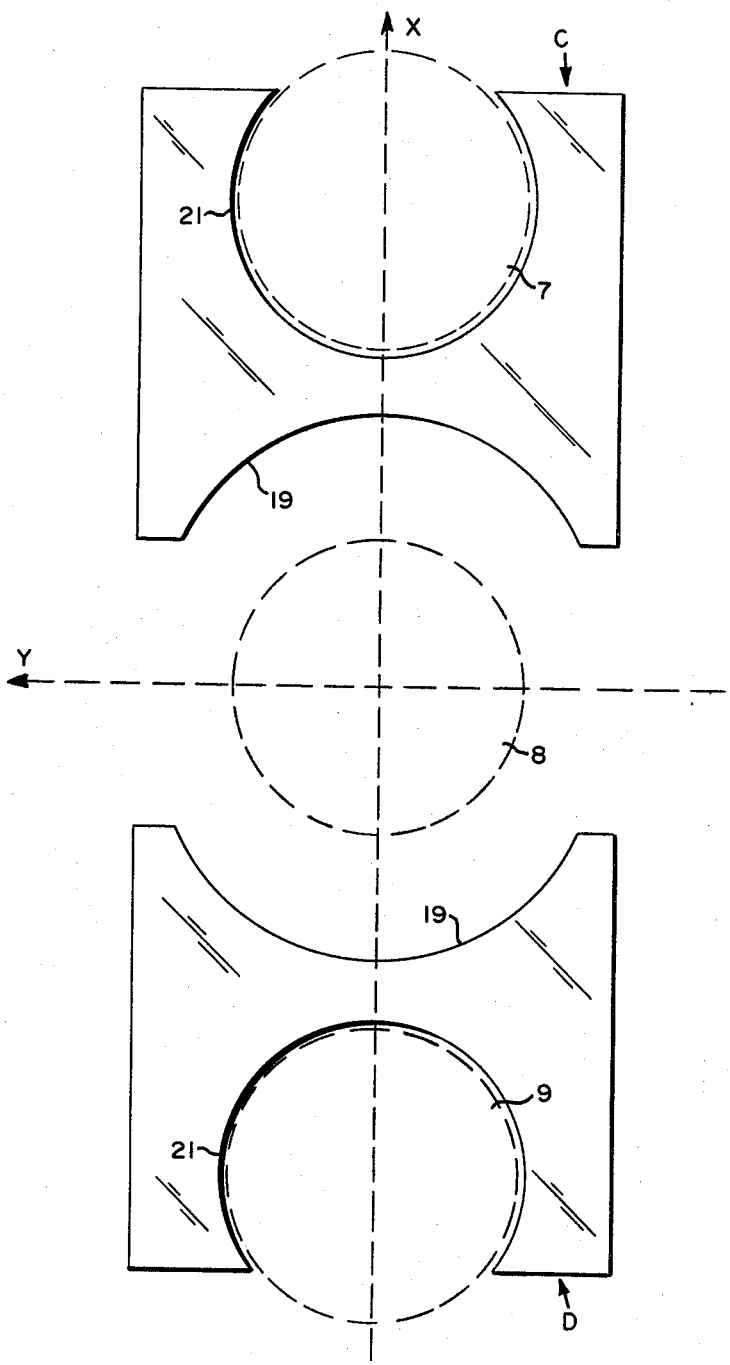
FIG. 5 is an enlarged view of an alternative embodiment of the invention.

In one preferred embodiment employing an inline cathode ray tube having a normal tube neck of about 36 mm, the following dimensions were found appropriate:

Distance between apertures—8 mm
Aperture diameter—4.8 mm
Mid portion 13
  x-direction—3 mm
  y-direction—4 mm
Wing portions 15 and 17—45° to y-axis
Distance of A+B
  in x-direction—5 mm Also, FIG. 5 illustrates another embodiment of the invention. Herein, the apertures 7, 8 and 9 of a convergence electrode have a pair of substantially U-shaped ferromagnetic sheets C and D disposed in mirror-image relationship with respect to the x and y-axes. Each of the sheets C and D includes an arc-like portion 19 adjacent to and spaced from the center aperture 8 and intermediate the center aperture 8 and the one of the outer apertures 7 and 9. This arc-like portion 19 is connected to another arc-like portion 21 which partially surrounds one of the outer apertures 7 and 9.

Figure 6:
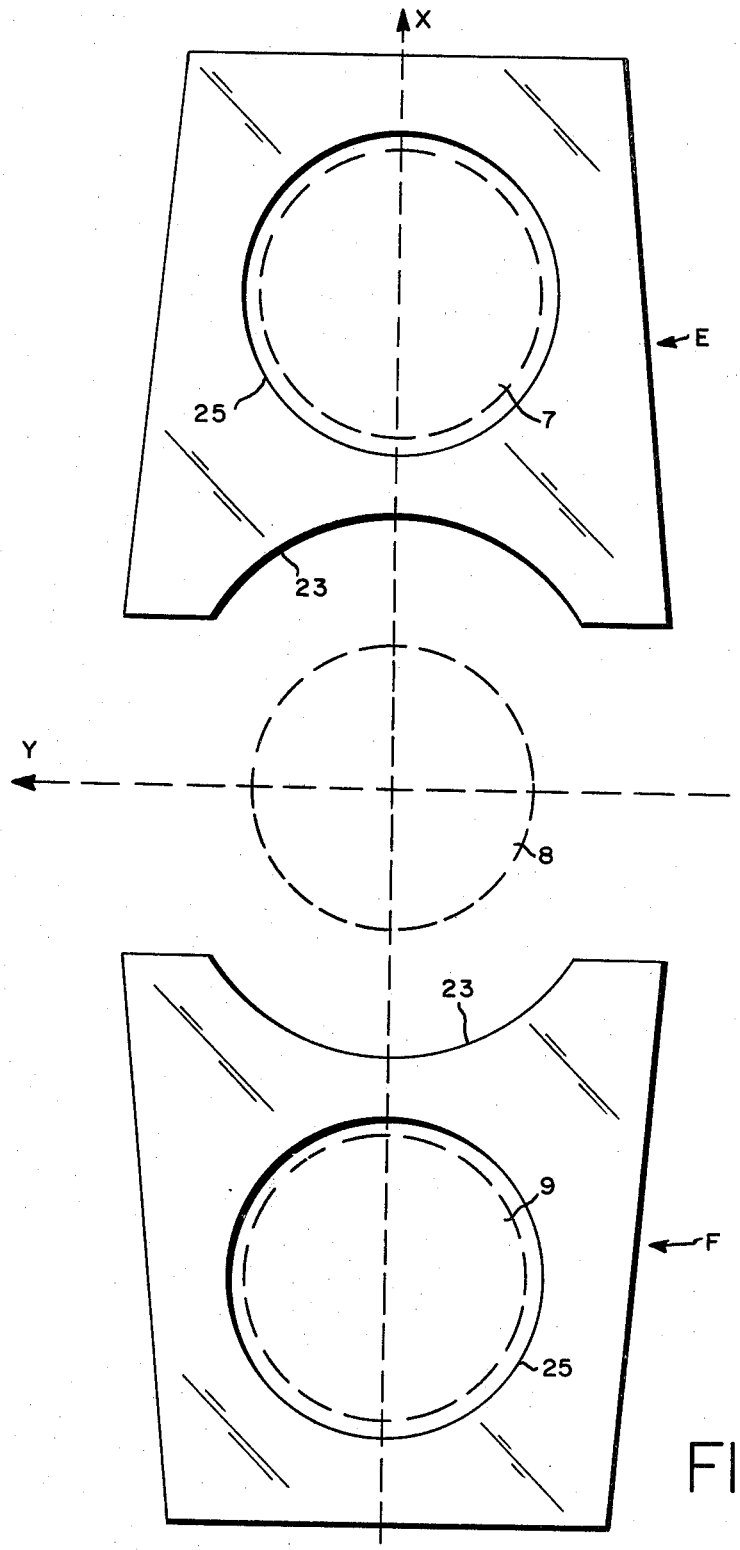
FIG. 6 is an enlarged view of another alternative embodiment of the invention.

In still another embodiment, FIG. 6 illustrates a pair of substantially U-shaped ferromagnetic sheets E and F disposed in mirror-image relationship with respect to the x and y axes of a convergence electrode. Therein, each of the sheets E and F includes an arc-like portion 23 adjacent to and spaced from the center aperture 8 and intermediate thereto and one of the outer apertures 7 and 9. This arc-like portion 23 extends outwardly to a hole 25 which surrounds one of the outer apertures 7 and 9.

Additionally, it may be noted that the substantially U-shaped configuration of the ferromagnetic sheets A through F cover a multitude of specific embodiments while still adhering to the substantial U-shaped form. Thus, it would be appropriate to consider a substantially V-shaped embodiment having an opening directed toward the outer apertures 7 and 9 and disposed in mirror-image relationship intermediate the central aperture 8 and each one of the outer apertures 7 and 9 as falling within the U-shape configuration concept.

While there has been shown and described what are at present considered the preferred embodiments of the invention it will be obvious to those skilled in the art that various changes and modifications may be made therein without departing from the invention as defined by the appended claims.

INDUSTRIAL APPLICABILITY

Thus, there has been provided a unique convergence electrode structure for self-converging inline cathode ray tube assembly. The structure virtually eliminates or at least greatly reduces undesired misconvergence or coma fault defects commonly associated with inline tube structures by strengthening the deflection field related to an electron beam passing through a central aperture while weakening the deflection field related to an electron beam passing through the pair of outer apertures. Thus, the vertical deflection field and resultant scanning raster are enhanced. Also, the structure provides a shunting capability for the deflection field affecting the horizontal deflection or scan by effecting different shunting of the deflection field associated with each electron beam.

Also, it is possible to select the amount of strengthening or weakening of the central and outer beams. For example, coma fault may be corrected by strengthening the field for the central beam without affecting the outer beams. Also, the magnetic field for the outer beams may be weakened without effect upon the central beam. Thus, the desired percentage of correction for the central beam and the outer beams is selectable.

We claim:

1. In a self-converging cathode ray tube assembly having an inline cathode ray tube with a convergence electrode having a substantially flat base and a central aperture aligned in a plane with two outer apertures formed to provide passageway for electron beams, the improvement characterized by two substantially flat sheets of ferromagnetic material affixed in planar relationship to said flat base and disposed in mirror-image relationship intermediate said central aperture and each one of said two outer apertures, each of said sheets of ferromagnetic material having a substantially U-shaped configuration with the open portion thereof directed toward one of said outer apertures of said convergence electrode whereby said ferromagnetic sheets provide a weakening effect upon the vertical deflection field for the electron beams passing through said two outer apertures and a strengthening effect upon the vertical deflection field for the electron beam passing through said central aperture.

2. The improvement of claim 1 wherein each of said ferromagnetic sheets includes a substantially rectangular-shaped portion intermediate said central aperture and one of said outer apertures and a pair of outwardly extending wing-like portions affixed to opposite ends of said rectangular-shaped portion and extending outwardly therefrom at an angle to at least partially shield said outer aperture.

3. The improvement of claim 1 wherein each one of said ferromagnetic sheets is in the form of a substantially arc-shaped portion spaced from said central aperture and connected to an arc-shaped portion spaced from and partially surrounding said outer aperture.

4. The improvement of claim 1 wherein each one of said ferromagnetic sheets is in the form of a substantially arc-shaped portion spaced from said central aperture and extending to a hole therein aligned with said outer aperture.

5. The improvement of claim 1 wherein each of said apertures has a diameter of about 4.8 mm, a space between apertures of about 8.0 mm and each of said sheets of ferromagnetic material has a substantially rectangular-shaped mid-portion extending about 3 mm in the plane of said apertures and 4 mm normal to said plane of said apertures and a pair of trapezoidal wing parts affixed to the opposite ends of said mid-portion and extending at an angle of about 45° in the direction of and to a plane extending through said outer apertures, each of said sheets of ferromagnetic material extending about 5 mm in the plane of said apertures and not projecting beyond an imaginary line normal to said plane of said apertures and through the center of said two outer apertures.

6. In a device for correcting horizontal and vertical misconvergence in a cathode ray tube of the inline type having a convergence electrode with a substantially flat base and a central and two outer apertures aligned along an x-axis and formed for passage of electron beams therethrough, the improvement comprising a pair of flat sheets of ferromagnetic material affixed in planar relationship to said flat base of said convergence electrode and disposed in mirror-image relationship intermediate said central aperture and each one of said two outer apertures with each of said sheets having a substantially U-shaped configuration and the open-portion thereof directed toward one of said two outer apertures.

7. The improvement of claim 6 wherein each of said sheets of ferromagnetic material has a U-shaped configuration in the form of a substantially rectangular-shaped portion intermediate said central aperture and one of said two outer apertures and a pair of wing-like portions affixed to opposite ends of each of said rectangular-shaped portions and extending outwardly therefrom toward said outer apertures at an angle displaced from said x-axis, said wing-like portions extending to an imaginary line normal to said x-axis and passing through the center of said outer apertures.

8. The improvement of claim 6 wherein said U-shaped configuration of each of said sheets of ferromagnetic material is formed to provide a substantially V-shape having a pair of wing-like members intersecting intermediate said central aperture and said outer aperture on said x-axis and the open portion of said V-shape directed toward said outer aperture.

9. The improvement of claim 6 wherein each of said U-shaped sheets of ferromagnetic material is in the form of an arc-like portion adjacent and spaced from said central aperture and intermediate said central aperture and an outer aperture and connected to an arc-like portion spaced from and partially surrounding said outer aperture, said arc-like portion partially surrounding said outer aperture extending to an imaginary plane normal to said x-axis and passing through the center of said outer aperture.

10. The improvement of claim 6 wherein each of said U-shaped sheets of ferromagnetic material is in the form of an arc-like portion adjacent and spaced from said central aperture and intermediate said central aperture and an outer aperture and extending to a hole surrounding said outer aperture.

11. The improvement of claim 6 wherein each of said U-shaped sheets of ferromagnetic material is in the form of a substantially rectangular-shaped portion intermediate said center and outer apertures with a wing-like portion affixed to each end of said rectangular-shaped portion and extending at an angle of about 45° to said x-axis and toward said outer aperture, each of said wing-like portions extending to an imaginary line normal to said x-axis and extending through the center of said outer aperture.

* * * * *